United States Patent [19]

Hedrich

[11] 4,289,493

[45] Sep. 15, 1981

[54] APPARATUS FOR APPLYING AN OVERLAY TO A SUBSTRATE

[75] Inventor: Winfried Hedrich, Rahden, Fed. Rep. of Germany

[73] Assignee: Rahdener Maschinenfabrik August Kolbus GmbH & Co. KG, Wesphalia, Fed. Rep. of Germany

[21] Appl. No.: 95,093

[22] Filed: Nov. 16, 1979

[30] Foreign Application Priority Data

Nov. 23, 1979 [DE] Fed. Rep. of Germany ..... 2850740

[51] Int. Cl.[3] ..... B65B 49/12

[52] U.S. Cl. ..... 493/389; 156/480; 493/386; 493/426; 493/443

[58] Field of Search ..... 93/54 R, 54.2, 36.6, 93/1 F; 156/479, 480, 477 B, 477 R; 493/386, 389, 424–426, 442–443, 454

[56] References Cited

U.S. PATENT DOCUMENTS

| | | | |
|---|---|---|---|
| 565,832 | 8/1896 | Brauer | 156/479 |
| 1,691,691 | 11/1928 | White | 156/480 |
| 1,950,550 | 3/1934 | Glass | 156/479 |
| 2,667,909 | 2/1954 | Stobb | 156/479 X |
| 2,749,967 | 6/1956 | Bach et al. | 156/479 |
| 3,874,276 | 4/1975 | Froehlig | 156/479 X |

*Primary Examiner*—James F. Coan

*Attorney, Agent, or Firm*—Fishman and Van Kirk

[57] ABSTRACT

An overlay is applied to a substrate, for example in the manufacture of book covers, by serially wrapping the overlay around a first pair of oppositely disposed edges of the substrate, folding the corners of the overlay into the substrate and wrapping the overlay around the two remaining edges of the substrate. The first wrapping of the overlay around a pair of edges of the substrate is accomplished by feeding the substrate with the overlay adhered thereto through a wrapping station alternately in opposite directions and deflecting the overhanging portion of the substrate at the leading edge out of the path of motion so that these overhanging portions may be engaged by a wrapping tool.

43 Claims, 12 Drawing Figures

FIG. 9a
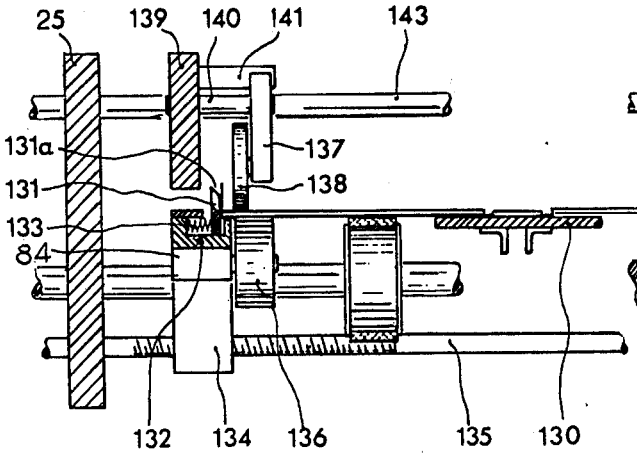
FIG. 9b
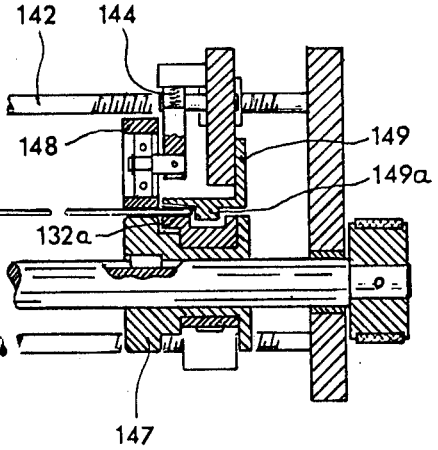
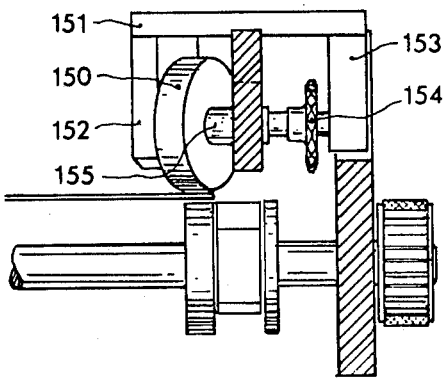
FIG. 9c

APPARATUS FOR APPLYING AN OVERLAY TO A SUBSTRATE

BACKGROUND OF THE INVENTION (1) Field of the Invention

The present invention relates to the wrapping of sheet material around cardboard or similar flat material to form an overlay. More specifically, the present invention is directed to apparatus for wrapping an overlay around the leading, trailing and side edges of a flat member such as, for example, the cardboard which may define the cover of a book. Accordingly, the general objects of the present invention are to provide novel and improved methods and apparatus of such character.

(2) Description of the Prior Art

While not limited thereto in its utility, the present invention is particularly well suited for use in the wrapping of overlay material around cardboard or similar flat materials in the manufacture of book covers. In the automatic production of book covers, it is known to wrap the overlay first around the lateral or side edges of the cover and then to subsequently wrap the overlay around the leading and trailing edges of the covers. In the prior art, in order to accomplish the lateral wrapping, the overlay material is laminated to the cardboard with the overlay extending past the edges of the cardboard, the laminate is advanced and gripped by feed chains and is thereafter raised upwardly at an angle of 90°. The overlay is then forced around the edges of the cardboard by inward moving wrapping shafts which travel with the covers. In the prior art apparatus, rotatably mounted wrapping fingers, arranged in a side-by-side relationship, are located across the direction of travel above the plane of motion of the covers for the purpose of folding the overlay around the leading edge. These wrapping fingers are bent at right angles opposite to the direction of travel and, in the ready position, press against a hold down shaft. Thus, the cover will run into the wrapping fingers and, when it overcomes the force of a spring bias thereon, will push the fingers out of the plane of motion. The overlay material is wrapped around the cardboard by the motion of the fingers as they pass over the leading edge of the cover. The trailing edge wrapping in the prior art apparatus is accomplished in the same manner but with wrapping fingers which are transported for a brief period with a considerable higher velocity than the speed of advance of the cover whereby the rear edge wrapping fingers force the overlay material around the cardboard upon overtaking the cover. A catch mechanism is required in order to avoid an extra displacement of the cover in the direction of travel when it is overtaken by the rear edge wrapping fingers.

Previously known methods and apparatus for the wrapping of overlay material around cardboard, the prior art apparatus briefly described above, for example, has not provided a completely satisfactory product. A first deficiency with the prior art apparatus resides in the fact that it is virtually impossible to apply adequate and even pressure to the overlay because of the relatively rapid sliding of the wrapping fingers around the edges of the cardboard and over the glueing area near the edges.

The clamping of the overlay to the cardboard for a significant period of time, the length of which depends on the type of adhesive used and also upon its coating thickness, is a factor which has not been taken into account in the design of prior automatic cover forming equipment. In order to achieve the requisite permanent adhesion of the overlay to the cover, the setting time of the glue is of particular importance. This is particularly critical when using comparatively stiff overlay materials such as Balacron, Skiveitx etc. As a result of the short period of time in which pressure is applied to urge the overlay against to cover in prior art equipment, the overlay often separates from the cardboard. This, of course, will lead to rejection of the cover.

Because of the exertion of only small clamping forces on the edges and on those areas of the covers immediately adjacent the edges, prior art automatic cover forming apparatus has been generally incapable of achieving a tight wrapping of the overlay around the cardboard; this being particularly true when comparatively stiff overlay materials are employed. The problem is not solved by increasing the applied pressure since this will invariably result in damage to the overlay and an unacceptable product. Thus, the well defined edges desired for book covers cannot be achieved using prior art wrapping systems and apparatus.

A further problem which has plagued prior art techniques, and which is attributable to the inability to obtain a tight wrapping, is the entrapment of air between the overlay and the cardboard and/or the production of covers having hollow edges.

As an additional deficiency of the prior art, because of the design of previously available automatic cover forming machines, a relatively short time is available for the clamping process and thus increases in production rate have not been possible.

SUMMARY OF THE INVENTION

The present invention overcomes the above briefly discussed and other deficiencies and disadvantages of the prior art by providing a novel and improved method for the wrapping of overlays around flat members and apparatus for use in the practice of this novel method. Apparatus in accordance with the present invention will automatically produce book covers of high quality and with a production rate substantially higher than previously obtainable.

Apparatus for automatically producing book covers in accordance with the present invention is characterized by a wrapping station through which the covers move subsequent to lamination of the overlay with the cover board. At the wrapping station the overlay material is folded around the leading and trailing edges of the cover and pressed down. A particularly unique feature of the invention resides in the fact that the covers are alternately moved through the wrapping station in two opposite directions and lifting elements are employed for each direction of movement to deflect the overlay material out of the path of motion whereby the overlay material will, by a wrapping tool, be folded around the edges of the cover and pressed tightly against the cover board.

In accordance with another feature of the preferred embodiment of the present invention, again considering the environment of a book cover producing apparatus, the apparatus is characterized by rails located beside the path of motion of the covers for lifting the overlay material which extends outwardly past the side edges of the cover board. Subsequent to the lifting, by means of the action of further rails, the overlay material is folded around the side edges of the cover board. The overlay is subsequently engaged by pressure rolls which are angularly oriented with respect to the direction of motion of the covers whereby the overlay is pressed tightly against the cover board while simultaneously being pulled around the edge thereof.

The present invention makes it possible to wrap overlay material around cardboard or similar flat materials with great precision and at a high operating speed. The overlay material extending beyond the cardboard is bent with sharp corners around the edges of the cardboard and is then pressed down flat to the cardboard surface. The setting time of the glue which bonds the overlay to the cardboard is taken into account by holding the overlay briefly to the cardboard. This brief holding of the overlay to the cardboard to achieve good adherence has a particularly favorable effect with stiff overlay materials having relatively large restoring forces. The pressure rolls which are angularly inclined with respect to the direction of motion of the covers during the side edge wrapping step exert a force perpendicular to the cover edge so that the lateral folds are pasted down perpendicular to the direction of travel as well as in the direction to travel.

Another feature of a book cover producing apparatus in accordance with a preferred embodiment of the present invention is the inclusion of uniquely designed turndown mechanisms for folding the overlay material at the corners of the leading and trailing edges of the cover board. These corner turndown mechanisms include elements which are caused to rotate. These rotating elements are provided with a pressure face which corresponds to the area of the overlay material to be turned down. The turndown elements move along the edges of the cover board with rolling contact on the overlay material which extends beyond the side edges of the cover board; this overlay material having previously been folded around the leading and trailing edges of the cover board. The corner turndown mechanisms act on the overlay during the continuous transport of the covers and the elements which act on the leading edge are driven so as to have a circumferential speed which is slower than the linear speed of the advancing cover. The corner turndown elements which act on the overlay material at the corners of the trailing edge are driven, at least momentarily, so as to have a circumferential speed which is faster than the rate of advancement of the cover. The corner turndown elements accomplish an inward shifting of the upper flap of the contacted overlay material at a sharp angle to the edge of the cover simultaneously with the folding in of the overlay to the side edges of the cover board. The corner turndown elements thus contribute to the manufacture of quality covers by eliminating projections, thick spots, cavities, etc., at the corners of the cover. Additionally, the areas to be turned down can be adjusted thereby reliably preventing glue stains on the inside of the cover.

BRIEF DESCRIPTION OF THE DRAWING

The present invention may be better understood and its numerous objects and advantages will become apparent to those skilled in the art by reference to the accompanying drawing wherein like reference numerals refer to like elements in the several FIGURES and in which:

FIGS. 9*a*, 9*b* and 9*c* are cross-sectional views of the preferred embodiment of the present invention respectively taken along lines G–H, I–K and L–M of FIG. 1*b*.

DESCRIPTION OF THE PREFERRED EMBODIMENT

Figures 1A, 3:
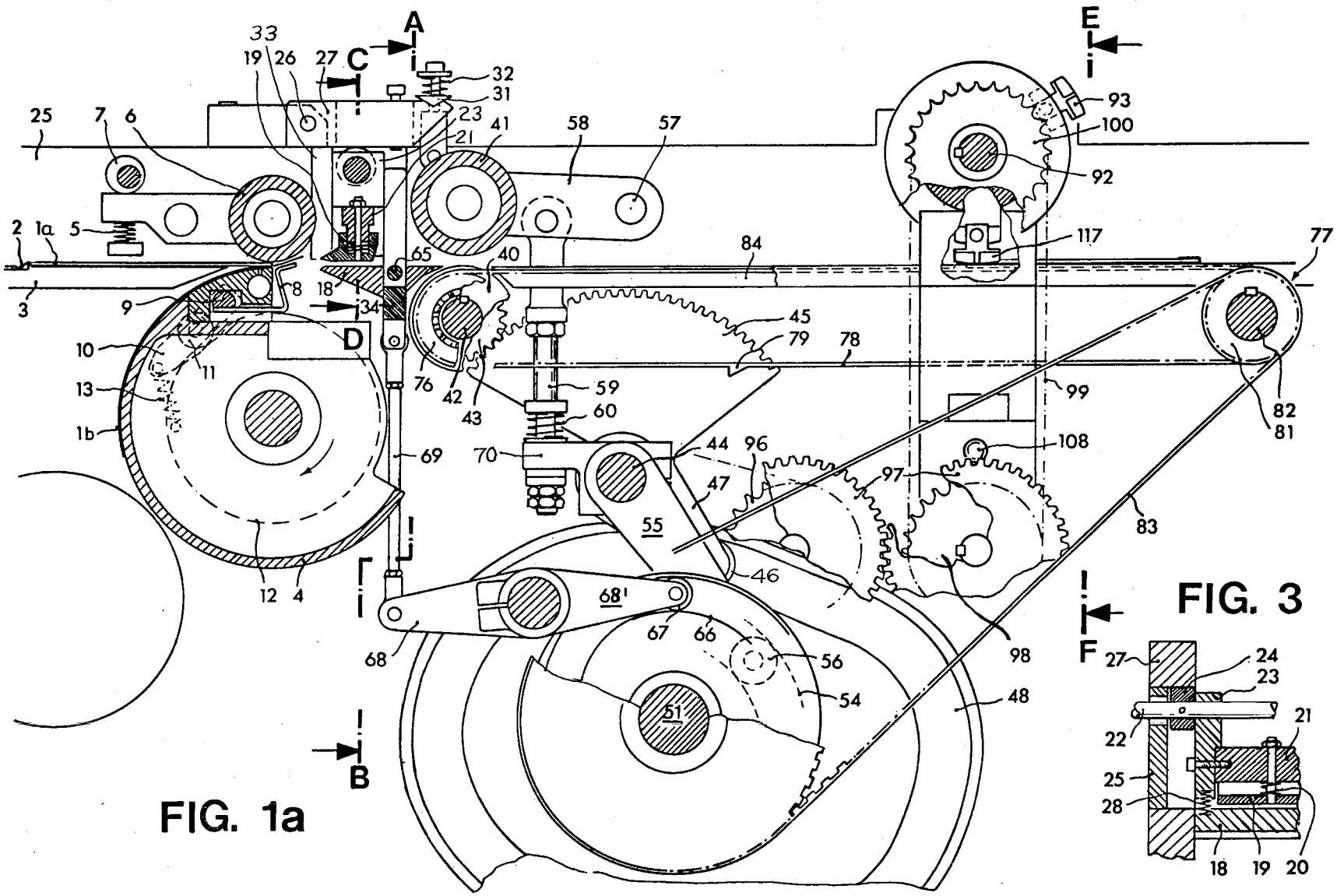
FIGS. 1*a* and 1*b* are schematic side elevation views, partly in section, of a preferred embodiment of the present invention.
FIG. 3 is a view, taken along line C–B, of a portion of the apparatus of FIG. 1*a;*

With reference now to the drawing, a preferred embodiment of apparatus in accordance with the invention as implemented for the manufacture of book covers is disclosed. As used herein the term book cover refers to the two rectangularly shaped flaps, which form the front and back covers of the book, and the central spine which connects these flaps. A book cover will typically be comprised of a cardboard inner member which is covered by means of a paper overlay. Referring to FIG. 1*a*, a cover board comprised of cardboard, indicated at 1*a*, is fed onto a table 3 by means of transporters 2 of a conveyor. The overlay material, indicated at 1*b*, has glue applied to a first side thereof and is thereafter fed into contact with the cover board 1*a*, at a laminating station, by means of a feed cylinder 4. A pressure roll 6 is positioned above the feed cylinder 4 and biased toward cylinder 4 by means of a spring 5. The pressure roll 6 is mounted on the end of a pivotal shaft and the clearance between the pressure roll and feed cylinder is adjustable by means of an eccentric 7. Feed cylinder 4 and pressure roll 6 are driven at the same speed and will move a cover board 1*a* initially to the right as the apparatus is shown in FIG. 1*a* while simultaneously laminating the overlay 1*b* thereto.

In order to accomplish the face wrapping of the cover; i.e., the folding of the overlay 1*b* around the four edges of the cover board 1*a;* the overlay material extending beyond the leading edge of the board is first deflected upwardly with respect to the board leading edge. For this purpose, the apparatus of FIG. 1 employs a lifting rake 8. The lifting rake 8 is comprised of an angular member which extends from and is connected rigidly to a rotatable shaft 9. Shaft 9 is located in the peripheral area of the side portion of feed cylinder 4 and is operated by means of a crank 10. An idler roll 11, which functions as a cam follower, is positioned intermediate the ends of crank 10. Idler roll 11 follows a stationary cam 12. The end of crank 10 disposed away from shaft 9 is biased toward cam 12 by means of spring 13 to insure that the roll 11 will follow cam 12. The cam 12 is shaped and oriented such that the rake 8 will swing upwardly and bend the overlay in the direction shown in FIG. 1*a* as the laminate leaves the nip of pressure roll 6 and feed cylinder 4. Due to the shape of cam 12 and the continued rotation of feed cylinder 4, the rake 8 will not act on the cover board 1*a*. The operation of rake 8 may be clearly seen from consideration of FIGS. 1*a* and 4–6.

Immediately following the laminating station, defined by pressure roll 6 and feed cylinder 4, the cover will be fed to a first wrapping station. The cover, with the overlay material bent upwardly around the leading edge, is driven by cylinder 4 and pressure roll 6 into the wrapping station. The first wrapping station includes a wrapping tool which extends over the width of the cover and comprises a fixed supporting table 18 and a wrapping rail 19. The wrapping rail 19 is supported above table 18, to thereby define a passageway for the book cover, on a transverse rail 21. As may be seen from joint consideration of FIGS. 1*a* and 3, wrapping rail 19 is biased away from the support rail 21 and toward table 18 by means of springs 20. By insuring the proper spacing between table 18 and rail 19, the portion of the overlay which is bent upwardly by rake 8 will be folded over and pressed down tightly against the upwardly facing side of cover 1*a* by means of rail 19 as the cover passes under rail 19 on table 18. The transverse support rail 21 is affixed to vertically movable holding blocks 23. The holding blocks 23 are supported on table 18 by means of compression springs 28 and are provided with through holes which receive a shaft 22. The holding blocks 23 are urged downwardly against the force of springs 28 by means of clamping bars 27. Clamping bars 27 are capable of pivotal motion about a transverse shaft 26 which is supported in the side frames 25 of the apparatus. The clamping bars 27 are held, at the ends thereof opposite to shaft 26, by catches 31 through the action of compression springs 32. Eccentric cams 24 are pinned to shaft 22 at the opposite sides of the blocks 23. The movement of blocks 23 is constrained to the vertical direction by means of guide rail 33, also mounted on the side frames 25, and a lifting frame 34. As will be explained in greater detail below, the lifting frame 34 undergoes vertical reciprocal motion through the supporting table 18. The size of the passageway between rail 19 and table 18 may be varied by rotation of shaft 22, by means not shown in the drawing, whereby the blocks 23 with move vertically with respect to clamping bars 27 as a function of the attitude of the cams 24.

Figure 7:
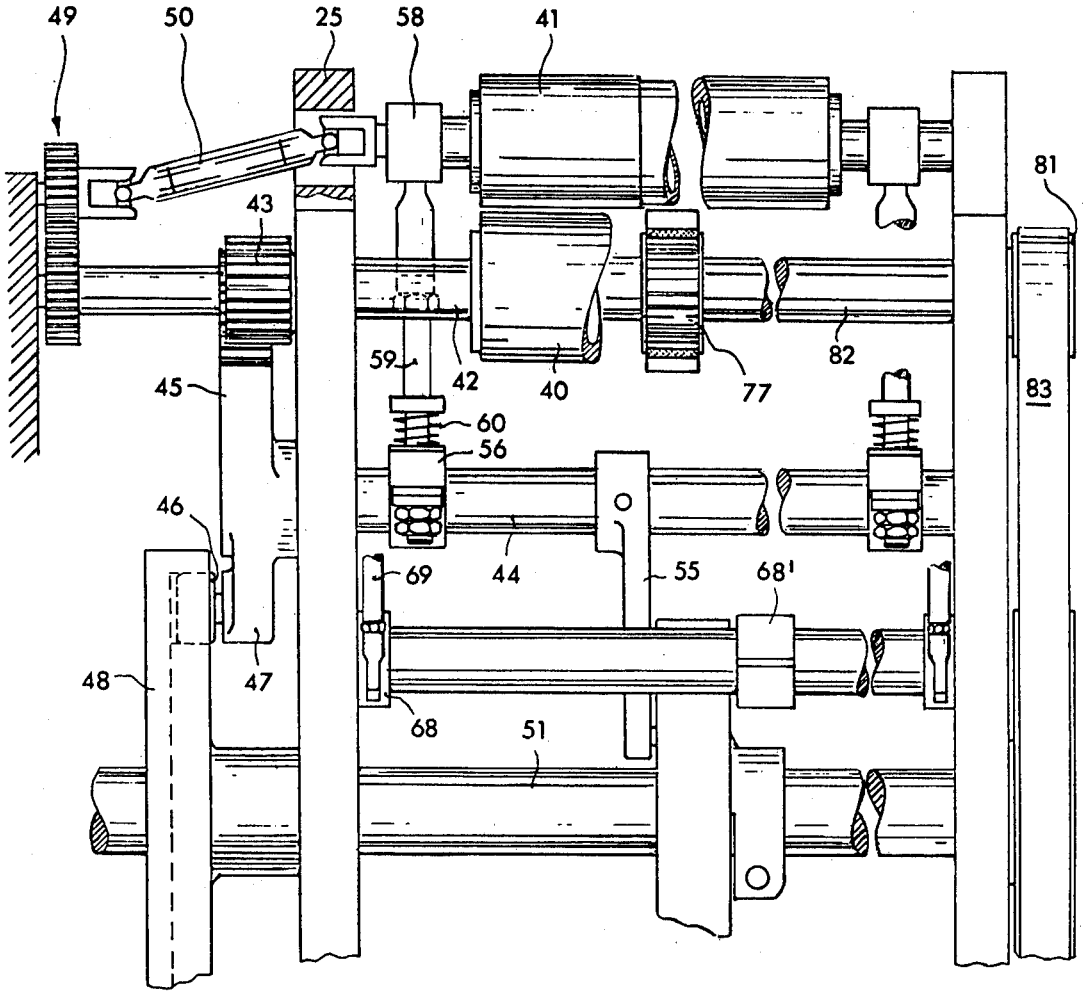
FIG. 7 is a view, taken along line A–B of FIG. 1*a*, of the preferred embodiment of the present invention with components removed in the interest of clarity.

The laminated cover board and overlay, with the overlay folded around the leading edge of the cover board and secured to the upwardly facing side thereof, will be engaged by a transport system including lower and upper rolls 40 and 41 after passage over table 18. The lower transport roll 40 is mounted in the side frames 25 on a shaft 42. A pinion 43 is keyed to shaft 42 and is engaged by a gear segment 45 which rotates about a shaft 44. Segment 45 is provided with an extension 47 which carries an idler roll 46 which functions as a cam follower. Idler roll 46 is in contact with a cam wheel 48 which is attached to the main drive shaft 51 of the apparatus. The movement of cam wheel 48 in response to rotation of shaft 51 imparts, via the idler roll 46 and segment 45, an oscillatory motion to pinion 43 and thus to lower transport roll 40. Thus, the roll 40 will rotate alternately in the clockwise and counterclockwise directions. As may be seen from FIG. 7, the upper transport roll 41 is driven with the same rotational motion as roll 40 through a pair of pinions 49 and a jointed shaft 50.

A second cam wheel 54 is affixed to main drive shaft 51 and is engaged by a follower roll 56 located at the end of a crank arm 55. The crank arm 55 is pinned to shaft 44 whereby the relative motion between cam 54 and follower 56 will result in the rotation of shaft 44. The motion of the shaft 44 is transmitted, via a clamping member 70, to a lift rod 59 which is linked, at its upper end, to an arm 58 which supports the upper transport roll 41. The arm 58 is mounted for rotation about pivot shaft 57 and thus roll 41 is capable of swinging into contact with the cover and acting to clamp the cover against lower transport roll 40. A compression spring 60 is positioned intermediate the clamping member 56 and the lifter rod 59 and biases roll 41 away from roll 40.

The covers passing over table 18 are engaged by rolls 40 and 41 and are moved to the right as the apparatus is shown in FIG. 1*a* for a distance determined by the size of the various components of the apparatus. This "forward" movement is controlled so that the cover will clear the first wrapping station. By means of the cooperation between cam wheel 48 and follower roll 46, when a limit of motion in the first direction is reached, the direction of rotation of the rolls 40 and 41 will be reversed and the cover will be fed back toward the first wrapping station. Before reintroduction of the cover into the wrapping tool, the overlay material extending beyond the rear edge of the cover board is lifted upwardly and folded around the trailing edge of the cover board by means of a lifting rod 65 which is carried by the previously mentioned lifting frame 34. Vertical motion of the lifting frame 34 in synchronism with the motion of the cover is achieved through the use of a cam wheel 66 which is also keyed to the main drive shaft 51. Cam 66 is engaged by a follower roll 67 attached to a first end of a swivel crank 68, 68' mounted on frame 25. The free end of crank 68 is attached to lifting frame 34 by means of a connecting rod mechanism 69.

The sequence of operations described above, and particularly the wrapping of the overlay around the forward edge of the cover board and subsequently around the trailing edge of the cover board may be seen from consideration of FIGS. 1*a*, 4, 5 and 6. In order to insure a trouble-free feed of the cover boards and the overlays laminated thereto, as may be seen from FIG. 4, the wrapping rail 19 is provided with a lead-in ramp 19*a* at a first side and an in-feed ramp 19*b* at the other side. The introduction of the covers into the wrapping station from both sides in accordance with the present invention, guarantees that the overlay material is drawn tightly around the board edges and is pasted down flat against the upper surface of the cover board.

After the wrapping of the overlay around the rearwardly disposed edge of the cover board has been completed, the clamping bars 27 are raised by means of the lifting frame 34 which continues its upward movement as the cover passes back under the lifting rod 65. Raising of clamping bars 27 enables the passageway between table 18 and wrapping rail 19 to enlarge through the action of the springs 28 (FIG. 3). Accordingly, when the direction of the transport rolls 40 and 41 is reversed, the cover will be again conveyed to the right, as the apparatus is shown in FIG. 1*a*, without interference from the wrapping tool.

The transport system following the wrapping station is comprised of an endless toothed feed belt 78 which passes about guide rolls 76 and 77; guide roll 76 being coaxial with transport roll 40. The transport system also comprises a pair of support rails 84 which support the covers at either side as they are carried along by belt 78 after being released from transport rolls 40 and 41. The guide roll 76 rotates freely on shaft 42 while guide roll 77 is keyed to a rotatable shaft 82. A pulley 81 is also affixed to shaft 82. Rotation of shaft 82, and thus the driving of belt 78, is accomplished from the main drive shaft 51 by means of a further toothed belt 83 which engages the aforementioned pulley 81 and a further pulley keyed to shaft 51. In order to prevent engagement of the covers by belt 78 in the region of the transport rolls 40 and 41, the conveyor belt 78 is located below the plane of the transport rolls.

Figure 8:
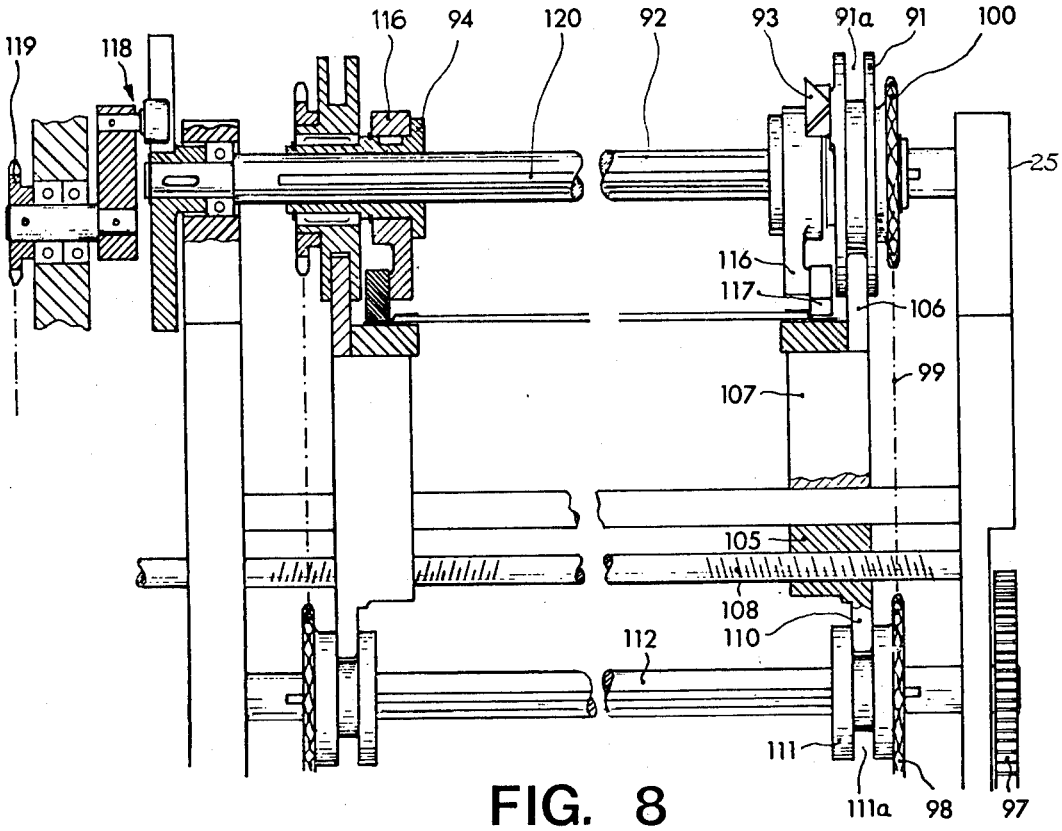
FIG. 8 is a view of the preferred embodiment of FIG. 1*a* taken along line E–F.

In the manufacture of a quality book cover, in the interest of avoiding projections, thick spots and cavities at the corners of the covers, it is necessary that the corners of the overlay be turned down prior to wrapping the overlay around the side edges of the cover board. The apparatus for producing this corner turndown at the leading edge, as depicted in FIGS. 1*a* and 8, consists a a pair of support elements 91 which are freely rotatable on bushings 94. The bushings 94 rotate about a shaft 92 which is mounted in the side frames 25. The rotating support elements 91 each carry a corner turndown element 93 which is positioned such as to engage the overlay at the corners of the leading edge of the cover. The turndown elements 93 are bolted to the inside of the rotating elements 91 and have a triangular pressure surface which is curved so as to conform with the path of travel of the advancing cover. The elements 93 fold the tabs of the overlay material which extend outwardly past the side edges of the cover board at a sharp angle to the edges of the cover and immediately thereafter press the folded overlay material against the cover board by means of a rolling contact at the edge of the board. This sharp shifting or folding of the overlay material is accomplished by causing the elements 93 to rotate at a circumferential speed which is lower than the speed of linear motion of the covers. Motion is imparted to the elements 91 by means of a chain drive which includes a sprocket 100 attached to each of rotating support elements 91, chains 99, further sprockets 98 and a gear train 97 which drives sprockets 98. The element rotation of the support elements 91 for the corner turndown elements 93 is synchronized with the feed of the covers by means of a further chain drive, including sprocket 96. The details of this further chain drive have been omitted from FIG. 1*a* in the interest of facilitating understanding of the invention.

In order to permit the apparatus to accomodate book covers of different widths, the position of the rotating support elements 91 on shaft 92 is made adjustable through the use of "pulling plates" 106. The "pulling plates" 106 engage grooves 91*a* in the support elements 91 and are coupled to further "pulling plates" 110 which engage the grooves 111*a* of collars 111 affixed to the chain sprocket 98. The sprockets 98 are mounted on a rotatable shaft 112 which is driven by means of the gear train 97. The supporting blocks 107 each include a portion 105 which defines a nut which engages an adjusting spindle 108. Accordingly, by rotating spindle 108, the spacing between the rotating support elements 91 may be varied.

In order to adjust the apparatus to accomodate book covers of varying lengths, the rear edge of the covers is utilized as the reference edge. Thus, the feed cylinder 4 will be rotated about its axis and the forward turndown elements 93 are adjusted relative to trailing edge turndown elements 117, which will be described below, by rotating the support elements 91 about shaft 92. In order to accomodate book covers of varying thickness, the corner turndown elements 93 may be radially adjusted, by means not shown, with respect to the rotating support elements 91.

In order to achieve corner turndown at the corners of the trailing edge of a cover being fed to the right as the apparatus is shown in FIG. 1*a*, further corner turndown elements 117 are located at both sides of the cover. The turndown elements 117 are mounted on rotating supports 116 as can best be seen from FIG. 8. The rotating supports 116 are affixed to the bushings 94 and, accordingly, have a fixed rotational relationship with regard to shaft 92. In order to achieve a shifting of the tabs in the same manner as described above with regard to the corners of the forward edge of the cover; i.e., in the direction of travel and towards the edge of the board; it is necessary that the corner turndown elements 117 rotate momentarily at a speed which is faster than the linear transport rate of the covers. In order to accomplish the foregoing, a drive system employing a crank slide, of known design which is indicated generally at 118, is employed. The bushings 94, and thus the rotating supports 116 for the turndown elements 117, are driven from the main drive by means of a chain which engages sprocket 119 and the requisite variation in speed of movement of the turndown elements 117 is achieved by coupling sprocket 119 to shaft 92 via the aforementioned crank slide 118 and a feather key connection 120. Because of the momentary increase in the speed of rotation of the supports 116, produced by the crank slide and feather key connection, the rear corner turndown element 117 "overtake" the overlay at the rear corners of the cover and shift the extending tabs of the overlay material at a sharp angle to the edge of the cover and thereafter press the overlay material which has extended beyond the board against the cover board by means of a rolling contact at the edge of the moving cover board. This action is analogous to the wrapping of the forward corners since there is a difference in speed between the turndown elements and the moving cover.

Because of the triangular shape of the corner turndown elements 93 and 117, which can be adapted to a wide variety of sizes of areas to be turned down, glue stains are avoided. A change in the effective pressure area of the corner turndown elements can be made by adjustment thereof relative to the direction of travel of their rotating supports.

Figure 1B:
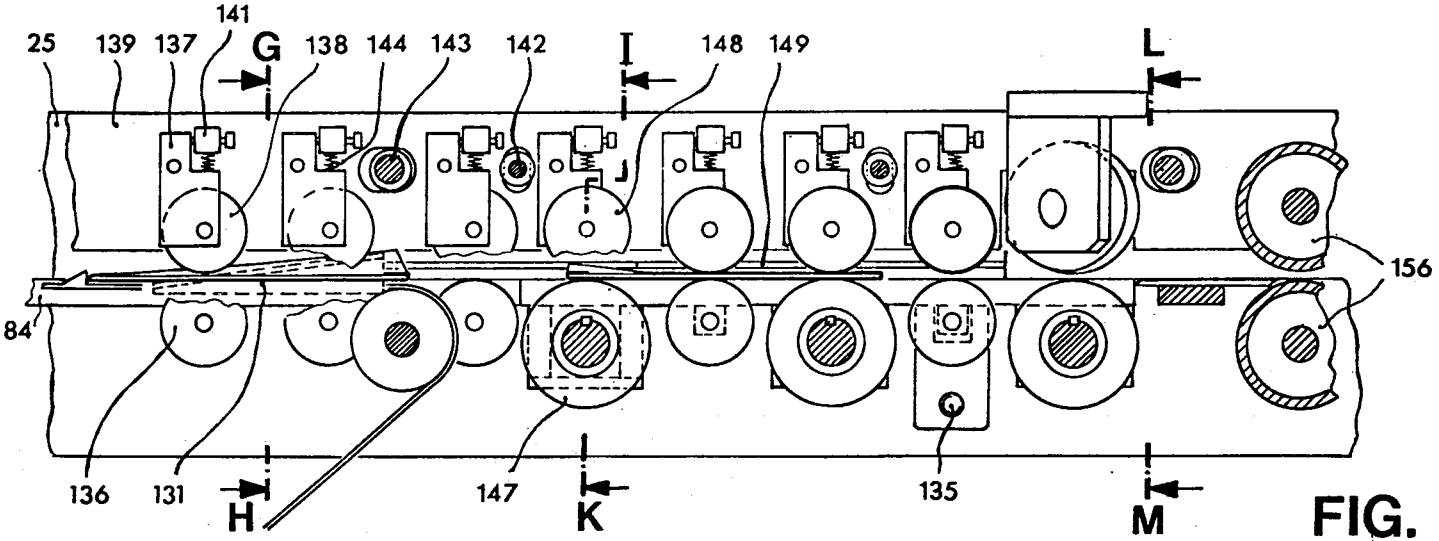

With reference now to FIGS. 1*b* and 9, after completion of the front and rear edge wrapping and the corner turndowns, the covers are fed to a side wrapping station by means of a drive projection 79 on belt 78 (see FIG. 1*a*). In the side wrapping station the covers are in part supported by a table 130. The overlay material extending beyond the side edges of the board is brought into the vertical position and thereafter pressed and held against the board edges by lifting strips 131 (FIGS. 1*a* and 9*a*). The lifting strips 131 are located in U-shaped guide profiles 132 in the support rails 84 and are resiliently urged against the edges of the cover by means of springs 133. The lifting strips 131 are installed on the sides of the path of travel of the cover and include a running surface which starts below the transport plane and rises in the direction of travel. As may be seen from FIG. 9*a*, the lifting strips also include a running surface 131*a* which slopes toward the cover.

For format adjustment, the support rails 84 are bolted to carrier blocks 134 which are provided with threaded through holes engaged by adjustment spindles 135. The adjustment spindles 135, in turn, are supported in the side frames 25. A series of freely rotatable support rolls 136 are positioned so as to support the edge areas of the covers. Counter-pressure rolls 138, rotatably mounted in swivel bearings 137, act from above on the edge areas of the covers. The rolls 138 are biased by springs 144 supported in stop members 141; the spring force being transmitted by swivel bearings 137. The amount of pressure exerted on the cover by rolls 138 is adjustable by means of rotating the swivel bearings 137 around freely rotatable shafts 140 extending from carriers 139. The carriers 139, as may be seen from FIG. 9*b*, engage a threaded section of an adjustment spindle 142 which is supported in the side frames 25. Thus, the format adjustment will be accomplished by rotation of spindles 135 and 142 while a height adjustment for cover materials of various thickness can be made by rotating an eccentric shaft 143 which extends through the carriers 139 and is supported by the side frame 125.

Figure 2:
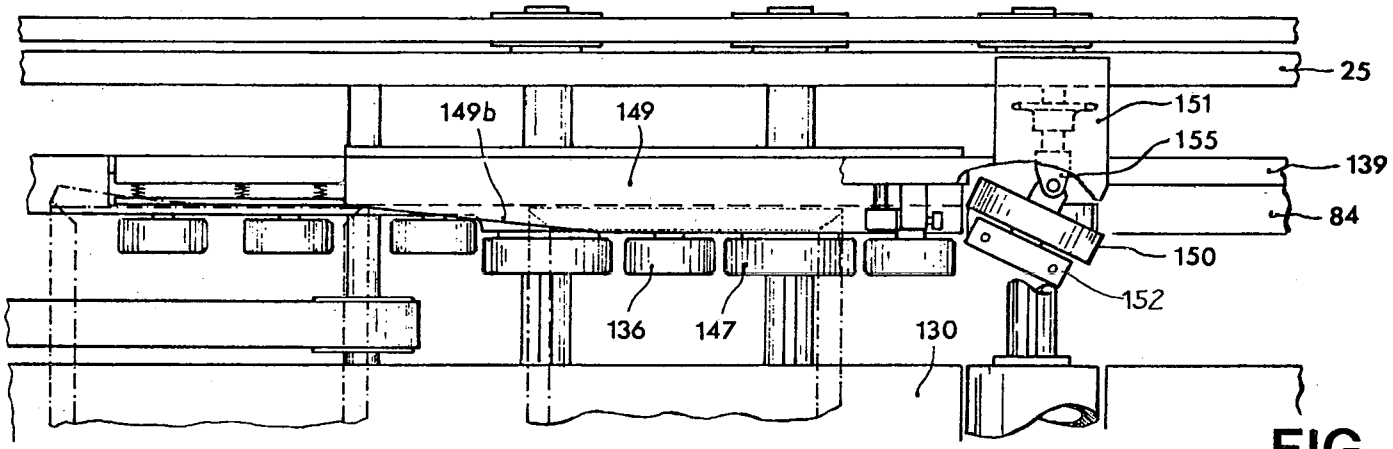
FIG. 2 is a top plan view of a portion of the apparatus depicted in FIG. 1*b;*
Figure 4:
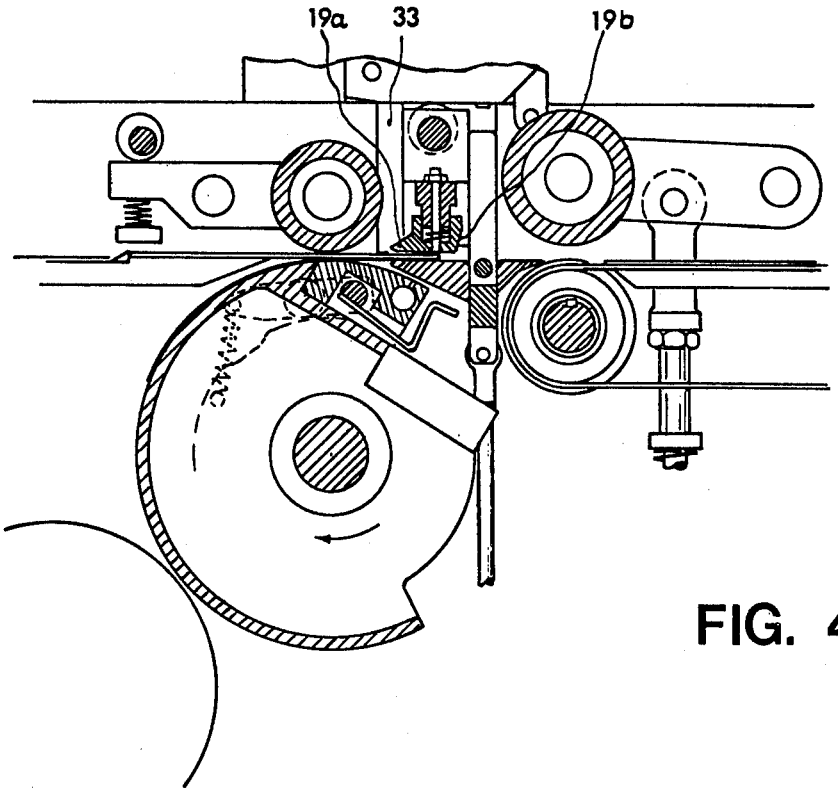
FIGS. 4, 5 and 6 are partial views, on an enlarged scale, of the apparatus of FIG. 1*a* depicting sequential steps in the operation of the embodiment of FIG. 1.
Figure 5:
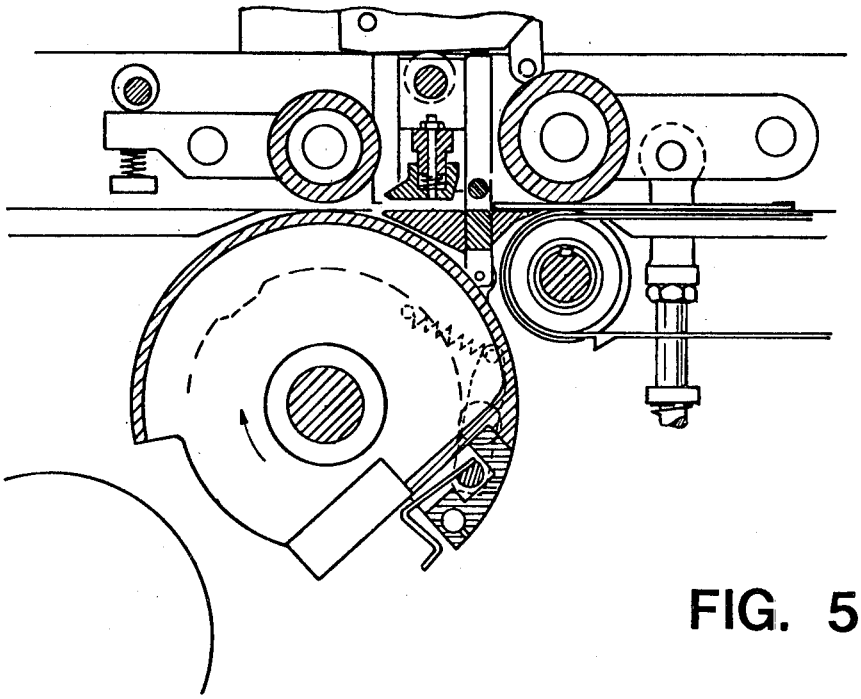
Figure 6:
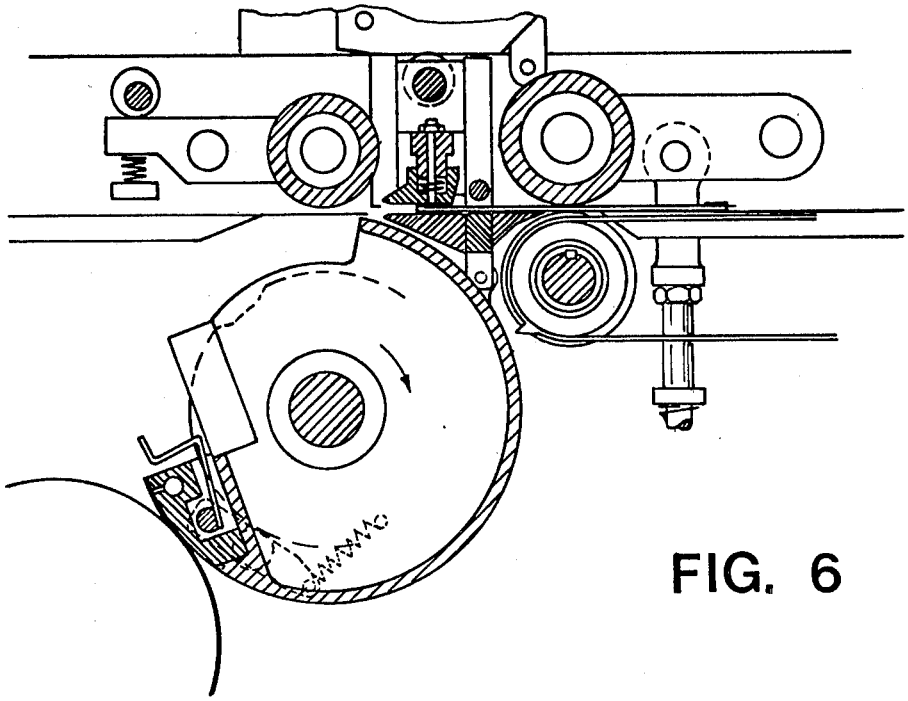

Referring jointly to FIGS. 1*b* and 2, after the overlay material extending beyond the side edges of the board has been lifted, the cover is transported by means of driven transport rolls 147 and counter-pressure rolls 148; rolls 148 being supported in the same manner as pressure rolls 138. In addition, further support rolls 136 are provided for the edge areas of the covers while the central portion of the covers rests on the support table 130.

Turndown rails 149 are mounted so as to form extensions of strips 131 on both sides of the cover. Turndown rails 149 are mounted from carriers 139 and have guide projections 149*a* which extend downwardly to be engaged in the guide profiles 132. The rails 84 have a widened support surface 132*a* in the area of the turndown rails 149. This support surface 132*a*, along with the bottom of the turndown rails 149 and the guide projections 149*a*, forms a guide slot which accepts the edges of the covers. This guide slot expands inwardly so as to become wider toward the cover. The turndown rails 149 are also provided with a ramp portion 149*b* which begins at the lifting strips 131 and extends inwardly across the edge of the cover as may be seen from FIG. 2. The turndown rails 149, accordingly, cause the overlay material to be bent back around the board but do not cause the overlay to be pressed against the board from above.

To press the overlay material down onto the board, angularly oriented pressure rolls 150 are located adjacent the ends of the turndown rails 149 and directly over a pair of the transport rolls 147. The pressure rolls 150 are driven in the direction of travel of the covers. Accordingly, components of force both longitudinally of and perpendicularly to the edges of the covers are exerted on the overlays as they are pressed downwardly so as to adhesively secure them to the cover board.

The pressure rolls 150 are mounted from frames 151 which, as can be seen from joint consideration of FIGS. 2 and 9*c*, are in turn mounted from the carriers 139. The frames 151 each include a pair of support frames 152 and 153 which support drive shaft 155 on which the pressure role 150 is mounted. The shafts 155 are coupled to drive pinions 154 which are caused to rotate by means not shown.

As a final step, after passing the pressure rolls 150, the covers are fed between a pair of driven pressure rolls 156 wherein they are subjected to a constant pressure which extends over the entire width of the covers.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. Apparatus for wrapping flexible sheet material around a rectangular substrate which is advanced along a path, the sheet material being adhered to a first surface of the substrate and extending beyond the edges thereof, said apparatus comprising:

wrapping means for pressing the sheet material against a second surface of the substrate, said second surface being opposite to the first surface, said wrapping means being positioned at a fixed location along the path;

means for transporting the substrate and adhered sheet material to said wrapping means along the path, said transporting means being reversible whereby the substrate may first be fed to said wrapping means in a first direction and then fed back to said wrapping means in a second direction;

first means for deflecting sheet material extending beyond a first edge of the substrate out of the direction of movement thereof prior to the feeding of the substrate and adhered sheet material to said wrapping means in the first direction whereby said sheet material will be engaged by said wrapping means and folded around a first edge of the substrate; and second means for deflecting the sheet material extending beyond a second edge of the substrate out of the direction of movement imparted thereto by said transporting means prior to the feeding of the substrate and adhered sheet material to said wrapping means in the second direction whereby said sheet material will be engaged by said wrapping means and wrapped around the second edge of said substrate, the substrate second edge being disposed oppositely to said substrate first edge.

2. The apparatus of claim 1 wherein said wrapping means comprises:

first table means, said first table means contacting the surface of the sheet material which faces outwardly with respect to the first surface of the substrate;

wrapping rail means, said wrapping rail means extending at an angle to the direction of motion of the substrate; and means supporting said wrapping rail means above said first table means to define a passageway therebetween.

3. The apparatus of claim 2 wherein said wrapping rail means supporting means is adjustable relative to said table means to vary the width of said passageway.

4. The apparatus of claim 3 wherein said wrapping rail means comprises:

a first frame member rigidly fixed to said supporting means;

a sheet material contacting rail oriented parallelly to said first frame member; and means resiliently supporting said sheet material contacting rail from said first frame member whereby said rail is biased toward said first table means.

5. The apparatus of claim 4 wherein said wrapping rail supporting means is resiliently coupled to said first table.

6. The apparatus of claim 1 further comprising:

lifting strip means, said lifting strip means being positioned to engage the sheet material extending outwardly past the side edges of the substrate, said lifting strip means raising the sheet material extending outwardly past the side edges of the substrate to an upright position, said lifting strip means being resiliently biased against the side edges of the substrate to insure that the sheet material is placed in direct contact with the side edges of the substrate;

folding means, said folding means being juxtapositioned to said lifting strip means in the direction of travel of the sheet material and the substrate, said folding means engaging the sheet material raised by said lifting strip means, said folding means bending said raised sheet material around the side edges of the substrate; and means for delivering the substrate with adhered sheet material to said lifting strip means and said folding means subsequent to the wrapping the sheet material around the first and second edges of the substrate.

7. The apparatus of claim 4 further comprising:

means for raising said wrapping rail means supporting means relative to said first table means to enlarge said passageway and thereby permit unimpeded motion of the substrate under said rail subsequent to the wrapping of the sheet material around the first and second edges of the substrate.

8. The apparatus of claim 1 wherein said first deflecting means comprises:

rotatable feed cylinder means, said feed cylinder means in part causing delivery of the sheet material and substrate to said transporting means;

a pivotal lifting element mounted for rotation within said feed cylinder means; and means for actuating said lifting element in synchronism with the delivery of the substrate and sheet material, said actuating means pivoting said lifting element into the path of motion of the substrate to raise the sheet material, extending beyond the first edge thereof for engagement by said wrapping means and subsequently pivoting said lifting element out of the path of rotation of the substrate.

9. The apparatus of claim 7 wherein said transporting means comprises:

a first transport roll, said first transport roll being positioned to contact the surface of said sheet material which faces outwardly with respect to said substrate;

means for causing said first transport roll to alternately rotate in the clockwise and counterclockwise directions;

a first pressure roll;

means for mounting said first pressure roll above said transport roll;

means for causing said first pressure roll to alternately rotate in the counterclockwise and clockwise directions in synchronism with the rotation of said first transport roll; and means for imparting motion to said first pressure roll mounting means to cause said first pressure roll to move into and out of contact with the second surface of the substrate to thereby cooperate with said first transport roll to impart motion to the substrate and adhered sheet material in the first and second directions.

10. The apparatus of claim 8 wherein said second deflecting means comprises:

lifting rod means; and means for causing said lifting rod means to pass through the path of motion of the substrate in synchronism with the movement of the substrate and adhered sheet material in the second direction whereby said lifting rod means will engage the sheet material extending beyond the second edge of the substrate during upward movement of said lifting rod means and movement of said substrate in the second direction.

11. The apparatus of claim 6 further comprising:

a pair of pressure rolls positioned at the end, in the direction of travel, of said lifting strip means and folding means, said pressure rolls being positioned at an angle with respect to the direction of travel of the substrate and contacting the sheet material which has been bent around the substrate side edges, said pressure rolls applying force to the sheet material in both the direction of travel and transverse to the direction of travel of the substrate; and means for imparting rotation to said pressure rolls.

12. Apparatus for wrapping flexible sheet material around a rectangular substrate, said sheet material being adhered to a first surface of the substrate and extending beyond the edges thereof, said apparatus comprising:

wrapping means for pressing the sheet material against a second surface of the substrate, said second surface being opposite to the first surface;

means for transporting substrate and adhered sheet material to said wrapping means, said transporting means being reversible whereby the substrate may be fed to said wrapping means alternately in first and second directions;

first means for deflecting sheet material extending beyond a first edge of the substrate out of the direction of movement thereof prior to the feeding of the substrate and adhered sheet material to said wrapping means in the first direction whereby said sheet material will be engaged by said wrapping means and folded around a first edge of the substrate; and second means for deflecting the sheet material extending beyond a second edge of the substrate out of the direction of movement imparted thereto by said transporting means prior to the feeding of the substrate and adhered sheet material to said wrapping means in the second direction whereby said sheet material will be engaged by said wrapping means and wrapped around the second edge of said substrate, the substrate second edge being disposed oppositely to said substrate first edge, said second means for deflecting sheet material including:

lifting rod means; and means for causing said lifting rod means to pass through the path of motion of the substrate in synchronism with the movement of the substrate and adhered sheet material in the second direction whereby said lifting rod means will engage the sheet material extending beyond the second edge of the substrate during upward movement of said lifting rod means and movement of said substrate in the second direction.

13. The apparatus of claim 12 wherein said wrapping means comprises:

first table means, said first table means contacting the surface of the sheet material which faces outwardly with respect to the first surface of the substrate;

wrapping rail means, said wrapping rail means extending at an angle to the direction of motion of the substrate; and means supporting said wrapping rail means above said first table means to define a passageway therebetween.

14. The apparatus of claim 13 wherein said wrapping rail means supporting means is adjustable relative to said table means to vary the width of said passageway.

15. The apparatus of claim 14 further comprising:

means for raising said wrapping rail means supporting means relative to said first table means to enlarge said passageway and thereby permit unimpeded motion of the substrate under said rail subsequent to the wrapping of the sheet material around the first and second edges of the substrate.

16. The apparatus of claim 15 wherein said transporting means comprises:

a first transport roll, said first transport roll being positioned to contact the surface of said sheet material which faces outwardly with respect to said substrate;

means for causing said first transport roll to alternately rotate in the clockwise and counterclockwise directions;

a first pressure roll;

means for mounting said first pressure roll above said transport roll;

means for causing said first pressure roll to alternately rotate in the counterclockwise and clockwise directions in synchronism with the rotation of said first transport roll; and means for imparting motion to said first pressure roll mounting means to cause said first pressure roll to move into and out of contact with the second surface of the substrate to thereby cooperate with said first transport roll to impart motion to the substrate and adhered sheet material in the first and second directions.

17. The apparatus of claim 12 further comprising:

turn down rail means, said turn down rail means including a pair of elongated members for engaging and subsequently turning around the side edges of the substrate the sheet material which extends outwardly past such side edges; and means for delivering the substrate with adhered sheet material to said turn down means subsequent to the wrapping of the sheet material around the first and second edges of the substrate.

18. The apparatus of claim 17 wherein said turn down rail means elongated members are positioned to contact the side edges of the moving substrate, said elongated members being shaped to engage the sheet material extending outwardly past the side edges of the substrate to lift the sheet material upwardly and thereafter guide the lifted sheet material inwardly whereby the sheet material is folded around the side edges of the substrate.

19. The apparatus of claim 18 further comprising:

a pair of pressure rolls positioned at the end, in the direction of travel, of said elongated members, said pressure rolls being positioned at an angle with respect to the direction of travel of the substrate and contacting the sheet material which has been folded around the substrate side edges, said pressure rolls applying force to the sheet material in both the direction of travel and transverse to the direction of travel of the substrate; and means for imparting rotation to said pressure rolls.

20. The apparatus of claim 12 further comprising:

lifting strip means, said lifting strip means being positioned to engage the sheet material extending outwardly past the side edges of the substrate, said lifting strip means raising the sheet material extending outwardly past the side edges of the substrate to an upright position, said lifting strip means being resiliently biased against the side edges of the substrate to insure that the sheet material is placed in direct contact with the side edges of the substrate;

folding means, said folding means being juxtapositioned to said lifting strip means in the direction of travel of the sheet material and the substrate, said folding means engaging the sheet material raised by said lifting strip means, said folding means bending said raised sheet material around the side edges of the substrate; and means for delivering the substrate with adhered sheet material to said lifting strip means and said folding means subsequent to the wrapping the sheet material around the first and second edges of the substrate.

21. The apparatus of claim 20 further comprising:

a pair of pressure rolls positioned at the end, in the direction of travel, of said lifting strip means and folding means, said pressure rolls being positioned at an angle with respect to the direction of travel of the substrate and contacting the sheet material which has been bent around the substrare side edges, said pressure rolls applying force to the sheet material in both the direction of travel and transverse to the direction of travel of the substrate; and means for imparting rotation to said pressure rolls.

22. Apparatus for wrapping flexible sheet material around a rectangular substrate, the sheet material being adhered to a first surface of the substrate and extending beyond the edges thereof, said apparatus comprising:

wrapping means for pressing the sheet material against a second surface of the substrate, said second surface being opposite to the first surface;

means for transporting the substrate and adhered sheet material to said wrapping means, said transporting means being reversible whereby the substrate may be fed to said wrapping means alternately in first and second directions;

first means for deflecting sheet material extending beyond a first edge of the substrate out of the direction of movement thereof prior to the feeding of the substrate and adhered sheet material to said wrapping means in the first direction whereby said sheet material will be engaged by said wrapping means and folded around a first edge of the substrate;

second means for deflecting sheet material extending beyond a second edge of said substrate out of the direction of movement imparted thereto by said transporting means prior to the feeding of the substrate and adhered sheet material to said wrapping means in the second direction whereby said sheet material will be engaged by said wrapping means and wrapped around the second edge of the substrate, the substrate second edge being disposed oppositely to said substrate first edge; and means for raising said wrapping means relative to the path of substrate and sheet material motion established by said transporting means to permit unimpeded motion of the substrate and sheet material through said wrapping means subsequent to the wrapping of the sheet material around the first and second edges of the substrate.

23. The apparatus of claim 22 further comprising:

turndown rail means, said turndown rail means including a pair of elongated members for engaging and subsequently turning around the side edges of the substrate the sheet material which extends outwardly past such side edges; and means for delivering the substrate with adhered sheet material to said turndown means subsequent to the wrapping of the sheet material around the first and second edges of the substrate.

24. The apparatus of claim 23 wherein said turndown rail means elongated members are positioned to contact the side edges of the moving substrate, said elongated members being shaped to engage the sheet material extending outwardly past the side edges of the substrate to lift the sheet material upwardly and thereafter guide the lifted sheet material inwardly whereby the sheet material is folded around the side edges of the substrate.

25. The apparatus of claim 24 further comprising:

a pair of pressure rolls positioned at the end, in the direction of travel, of said elongated members, said pressure rolls being positioned at an angle with respect to the direction of travel of the substrate and contacting the sheet material which has been folded around the substrate side edges, said pressure rolls applying force to the sheet material in both the direction of travel and transverse to the direction of travel of the substrate; and means for imparting rotation to said pressure rolls.

26. The apparatus of claim 22 further comprising:

lifting strip means, said lifting strip means being positioned to engage the sheet material extending outwardly past the side edges of the substrate, said lifting strip means raising the sheet material extending outwardly past the side edges of the substrate to an upright position, said lifting strip means being resiliently biased against the side edges of the substrate to insure that the sheet material is placed in direct contact with the side edges of the substrate;

folding means, said folding means being juxtapositioned to said lifting strip means in the direction of travel of the sheet material and the substrate, said folding means engaging the sheet material raised by said lifting strip means, said folding means bending said raised sheet material around the side edges of the substrate; and means for delivering the substrate with adhered sheet material to said lifting strip means and said folding means subsequent to the wrapping the sheet material around the first and second edges of the substrate.

27. The apparatus of claim 26 further comprising:

a pair of pressure rolls positioned at the end, in the direction of travel, of said lifting strip means and folding means, said pressure rolls being positioned at an angle with respect to the direction of travel of the substrate and contacting the sheet material which has been bent around the substrate side edges, said pressure rolls applying force to the sheet material in both the direction of travel and transverse to the direction of travel of the substrate; and means for imparting rotation to said pressure rolls.

28. Apparatus for wrapping flexible sheet material around a rectangular substrate, the sheet material being adhered to a first surface of the substrate and extending beyond the edges thereof, said apparatus comprising:

wrapping means for pressing the sheet material against a second surface of the substrate, said second surface being opposite to the first surface;

means for transporting the substrate and adhered sheet material to said wrapping means, said transporting means being reversible whereby the substrate may be fed to said wrapping means alternately in first and second directions;

first means for deflecting sheet material extending beyond a first edge of the substrate out of the direction of movement thereof prior to the feeding of the substrate and adhered sheet material to said wrapping means in the first direction whereby said sheet material will be engaged by said wrapping means and folded around a first edge of the substrate;

second means for deflecting the sheet material extending beyond a second edge of the substrate out of the direction of movement imparted thereto by said transporting means prior to said feeding of the substrate and adhered sheet material to said wrapping means in the second direction whereby said sheet material will be engaged by said wrapping means and wrapped around the second edge of said substrate, the substrate second edge being disposed oppositely to said substrate first edge; and corner turn down means for engaging the sheet material extending beyond the side edges of the substrate at the corners of said first and second edges subsequent to the wrapping of the sheet material around said first and second edges, said corner turn down means folding the wrapped sheet material inwardly toward the substrate and pressing it downwardly against the substrate, said corner turn down means including:

a first pair of rotatable turn down elements, each of said turn down elements of said first pair having a pressure surface commensurate with the surface area of the sheet material to be turned down, said turn down elements of said first pair cooperating with said sheet material at the corners of the first edge of the substrate;

a second pair of rotatable turn down elements, the elements of said second pair each having a pressure surface commensurate with the surfaces of the sheet material to be turned down, the elements of said second pair cooperating with the sheet material at the corners of the second edge of the substrate;

means for causing said first corner turn down elements to rotate together at a circumferential speed which is less than the linear speed of movement of the substrate;

means for causing the corner turn down elements of said second pair to rotate at a circumferential speed which is greater than the rate of linear motion of the substrate; and means for moving the substrate and adhered sheet material past said corner turn down means.

29. The apparatus of claim 28 wherein said corner turndown means further comprises:

a plurality of rotatable support members, one of said corner turndown elements being mounted on each of said rotatable support elements; and a common support shaft for said rotatable support elements the orientation of said corner turndown elements of said first and second pairs on said common support shaft being adjustable to insure that the turndown elements of said pairs respectively and serially contact the sheet material at the corners of the first and second substrate edges.

30. The apparatus of claim 28 wherein said wrapping means comprises:

first table means, said first table means contacting the surface of the sheet material which faces outwardly with respect to the first surface of the substrate;

wrapping rail means, said wrapping rail means extending at an angle to the direction of motion of the substrate; and means supporting said wrapping rail means above said first table means to define a passageway therebetween.

31. The apparatus of claim 30 wherein said transporting means comprises:

a first transport roll, said first transport roll being positioned to contact the surface of said sheet material which faces outwardly with respect to said substrate;

means for causing said first transport roll to alternately rotate in the clockwise and counterclockwise directions;

a first pressure roll;

means for mounting said first pressure roll above said transport roll;

means for causing said first pressure roll to alternately rotate in the counterclockwise and clockwise direction in synchronism with the rotation of said first transport roll; and means for imparting motion to said first pressure roll mounting means to cause said first pressure roll to move into and out of contact with the second surface of the substrate to thereby cooperate with said first transport roll to impart motion to the substrate and adhered sheet material in the first and second directions.

32. The apparatus of claim 31 wherein said first deflecting means comprises:

rotatable feed cylinder means, said feed cylinder means in part causing delivery of the sheet material and substrate to said transporting means;

a pivotal lifting element mounted for rotation within said feed cylinder means; and means for actuating said lifting element in synchronism with the delivery of the substrate and sheet material, said actuating means pivoting said lifting elements into the path of motion of the substrate to raise the sheet material extending beyond the first edge thereof for engagement by said wrapping means and subsequently pivoting said lifting element out of the path of rotation of the substrate.

33. The apparatus of claim 32 wherein said second deflecting means comprises:

lifting rod means; and means for causing said lifting rod means to pass through the path of motion of the substrate in synchronism with the movement of the substrate and adhered sheet material in the second direction whereby said lifting rod means will engage the sheet material extending beyond the second edge of the substrate during upward movement of said lifting rod means and movement of said substrate in the second direction.

34. The apparatus of claim 28 further comprising:

turndown rail means, said turndown rail means including a pair of elongated members for engaging and subsequently turning around the side edges of the substrate the sheet material which extends outwardly past such side edges; and means for delivering the substrate with adhered sheet material to said turndown means subsequent to the wrapping of the sheet material around the first and second edges of the substrate.

35. The apparatus of claim 34 wherein said transporting means comprises:

a first transport roll, said first transport roll being positioned to contact the surface of said sheet material which faces outwardly with respect to said substrate;

means for causing said first transport roll to alternately rotate in the clockwise and counterclockwise directions;

a first pressure roll;

means for mounting said first pressure roll above said transport roll;

means for causing said first pressure roll to alternately rotate in the counterclockwise and clockwise directions in synchronism with the rotation of said first transport roll; and means for imparting motion to said first pressure roll mounting means to cause said first pressure roll to move into and out of contact with the second surface of the substrate to thereby cooperate with said first transport roll to impart motion to the substrate and adhered sheet material in the first and second directions.

36. The apparatus of claim 28 further comprising:

lifting strip means, said lifting strip means being positioned to engage the sheet material extending outwardly past the side edges of the substrate, said lifting strip means raising the sheet material extending outwardly past the side edges of the substrate to an upright position, said lifting strip means being resiliently biased against the side edges of the substrate to insure that the sheet material is placed in direct contact with the side edges of the substrate;

folding means, said folding means being juxtapositioned to said lifting strip means in the direction of travel of the sheet material and the substrate, said folding means engaging the sheet material raised by said lifting strip means, said folding means bending said raised sheet material around the side edges of the substrate; and means for delivering the substrate with adhered sheet material to said lifting strip means and said folding means subsequent to the wrapping the sheet material around the first and second edges of the substrate.

37. The apparatus of claim 36 further comprising:

a pair of pressure rolls positioned at the end, in the direction of travel, of said lifting strip means and folding means, said pressure rolls being positioned at an angle with respect to the direction of travel of the substrate and contacting the sheet material which has been bent around the substrate side edges, said pressure rolls applying force to the sheet material in both the direction of travel and transverse to the direction of travel of the substrate; and means for imparting rotation to said pressure rolls.

38. Apparatus for wrapping flexible sheet material around a rectangular substrate, the sheet material being adhered to a first surface of the substrate and extending beyond the edges thereof, said apparatus comprising:

wrapping means for pressing the sheet material against a second surface of the substrate, said second surface being opposite to the first surface;

means for transporting the substrate and adhered sheet material to said wrapping means, said transporting means being reversible whereby the substrate may be fed to said wrapping means alternately in first and second directions, said transporting means including:

a first transport roll, said first transport roll being positioned to contact the surface of said sheet material which faces outwardly with respect to said substrate;

means for causing said first transport roll to alternately rotate in the clockwise and counterclockwise directions;

a first pressure roll;

means for mounting said first pressure roll above said transport roll;

means for causing said first pressure roll to alternately rotate in counterclockwise and clockwise directions in synchronism with the rotation of said first transport roll; and means for imparting motion to said first pressure roll mounting means to cause said first pressure roll to move into and out of contact with the second surface of the substrate to thereby cooperate with said first transport roll to impart motion to substrate and adhered sheet material in the first and second directions;

first means for deflecting sheet material extending beyond a first edge of the substrate out of the direction of movement thereof prior to the feeding of the substrate and adhered sheet material to said wrapping means in the first direction whereby said sheet material will be engaged by said wrapping means and folded around a first edge of the substrate; and second means for deflecting sheet material extending beyond a second edge of the substrate out of the direction of movement imparted thereto by said transporting means prior to the feeding of the substrate and adhered sheet material to said wrapping means in the second direction whereby said sheet material will be engaged by said wrapping means and wrapped around the second edge of said substrate, the substrate second edge being disposed oppositely to said substrate first edge.

39. The apparatus of claim 38 further comprising:

turn down rail means, said turn down rail means including a pair of elongated members for engaging and subsequently turning around the side edges of the substrate the sheet material which extends outwardly past such side edges; and means for delivering the substrate with adhered sheet material to said turn down means subsequent to the wrapping of the sheet material around the first and second edges of the substrate.

40. The apparatus of claim 39 wherein said turn down rail means elongated members are positioned to contact the side edges of the moving substrate, said elongated members being shaped to engage the sheet material extending outwardly past the side edges of the substrate to lift the sheet material upwardly and thereafter guide the lifted sheet material inwardly whereby the sheet material is folded around the side edges of the substrate.

41. The apparatus of claim 40 further comprising:

a pair of pressure rolls positioned at the end, in the direction of travel, of said elongated members, said pressure rolls being positioned at an angle with respect to the direction of travel of the substrate and contacting the sheet material which has been folded around the substrate side edges, said pressure rolls applying force to the sheet material in both the direction of travel and transverse to the direction of travel of the substrate; and means for imparting rotation to said pressure rolls.

42. The apparatus of claim 38 further comprising:

lifting strip means, said lifting strip means being positioned to engage the sheet material extending outwardly past the side edges of the substrate, said lifting strip means raising the sheet material extending outwardly past the side edges of the substrate to an upright position, said lifting strip means being resiliently biased against the side edges of the substrate to insure that the sheet material is placed in direct contact with the side edges of the substrate;

folding means, said folding means being juxtapositioned to said lifting strip means in the direction of travel of the sheet material and the substrate, said folding means engaging the sheet material raised by said lifting strip means, said folding means bending said raised sheet material around the side edges of the substrate; and means for delivering the substrate with adhered sheet material to said lifting strip means and said folding means subsequent to the wrapping the sheet material around the first and second edges of the substrate.

43. The apparatus of claim 42 further comprising:

a pair of pressure rolls positioned at the end, in the direction of travel, of said lifting strip means and folding means, said pressure rolls being positioned at an angle with respect to the direction of travel of the substrate and contacting the sheet material which has been bent around the substrate side edges, said pressure rolls applying force to the sheet material in both the direction of travel and transverse to the direction of travel of the substrate; and means for imparting rotation to said pressure rolls.

* * * * *